United States Patent [19]

Okada

[11] Patent Number: 4,573,681

[45] Date of Patent: Mar. 4, 1986

[54] SLOT MACHINE WITH RANDOM NUMBER GENERATION

[75] Inventor: Kazuo Okada, Tokyo, Japan

[73] Assignee: Kabushiki Kaisha Universal, Tochigi, Japan

[21] Appl. No.: 596,303

[22] Filed: Apr. 3, 1984

[30] Foreign Application Priority Data

Apr. 8, 1983 [JP] Japan ..... 58-61592

[51] Int. Cl.[4] ..... A63F 5/04

[52] U.S. Cl. ..... 273/143 R; 273/138 A; 364/412; 364/717

[58] Field of Search ..... 273/1 E, 1 GC, 85 G, 273/138 A, 143 R; 364/410–412, 717; 194/30, DIG. 11

[56] References Cited

U.S. PATENT DOCUMENTS 4,448,419 5/1984 Telnaes ..... 273/143 R

*Primary Examiner*—Richard C. Pinkham

*Assistant Examiner*—MaryAnn Stoll Lastova

*Attorney, Agent, or Firm*—Young & Thompson

[57] ABSTRACT

A slot machine is provided which has a winning probability table for storing a relation between a group and random numbers, the group being one of a plurality of groups made up by classifying prize-winning symbol combinations. The range of random numbers is properly fixed so that the winning probability is determined. Prior to the start of a game, one of the random numbers is sampled from a plurality of random numbers. The decisions on whether there is a win or not, and on which group the sampled random number belongs to if there is a win, are made with reference to the winning probability table. A hit request signal is generated for the latter decision. The hits are of different sizes, that is to say that different hits pay different numbers of wins. The larger the hit, the fewer random numbers correspond to it. The stopping series of symbols is controlled in accordance with the hit request signal.

12 Claims, 26 Drawing Figures

| NUMBER OF COINS INSERTED \ HIT | BIG | MIDDLE | SMALL |
|---|---|---|---|
| 1 | B1 | M1 | S1 |
| 2 | B2 | M2 | S2 |
| 3 | B3 | M3 | S3 |

FIG. 12

| 1st REEL | | | 2nd REEL | | | 3rd REEL | | |
|---|---|---|---|---|---|---|---|---|
| CODE NO. | SYMBOL NO. | SYMBOL | CODE NO. | SYMBOL NO. | SYMBOL | CODE NO. | SYMBOL NO. | SYMBOL |
| 20 | 6 | F | 20 | 4 | D | 20 | 6 | F |
| 19 | 5 | E | 19 | 6 | F | 19 | 5 | E |
| 18 | 3 | C | 18 | 2 | B | 18 | 4 | D |
| 17 | 6 | F | 17 | 4 | D | 17 | 6 | F |
| 16 | 2 | B | 16 | 7 | G | 16 | 3 | C |
| 15 | 6 | F | 15 | 5 | E | 15 | 8 | H |
| 14 | 3 | C | 14 | 1 | A | 14 | 6 | F |
| 13 | 5 | E | 13 | 4 | D | 13 | 5 | F |
| | | | | | | | 7 | A |
| 4 | 6 | F | 4 | 1 | A | 4 | 6 | F |
| 3 | 3 | C | 3 | 7 | G | 3 | 5 | E |
| 2 | 6 | F | 2 | 4 | D | 2 | 6 | F |
| 1 | 7 | G | 1 | 3 | C | 1 | 8 | H |
| 0 | 1 | A | 0 | 5 | E | 0 | 2 | B |

FIG. 14

RAM 1

| R1 | R2 | R3 |
|---|---|---|
| 14 | 0 | 2 |

RAM 2

| R1 | R2 | R3 |
|---|---|---|
| 6(F) | 3(C) | 5 (E) |
| 3(C) | 5(E) | 6(F) |
| 5(E) | 4(D) | 8(H) |

RAM 3

| | R1 | R2 | R3 |
|---|---|---|---|
| LINE 1 | 3(C) | 5(E) | 6(F) |
| LINE 2a | 6(F) | 3(C) | 5(E) |
| LINE 2b | 5(E) | 4(D) | 8(H) |
| LINE 3a | 6(F) | 5(E) | 8(H) |
| LINE 3b | 5(E) | 5(E) | 5(E) |

RAM 4

| 4a | 4b |
|---|---|
| 0 | 10 |

RAM 5

| 5a | 5b | 5c | 5d |
|---|---|---|---|
| 0 | 1 | 0 | 0 |

FIG. 15

| 1st REEL | | 2nd REEL | | 3rd REEL | | BONUS FLAG | NO. OF COINS | |
|---|---|---|---|---|---|---|---|---|
| SYMBOL NO. | SYMBOL | SYMBOL NO. | SYMBOL | SYMBOL NO. | SYMBOL | 1 : SET 0 : NOT SET | | |
| 7 | G | 7 | G | ANY | ANY | 0 | 5 | SMALL HIT |
| 7 | G | ANY | ANY | ANY | ANY | 0 | 2 | |
| 1 | A | 1 | A | 1 | A | 1 | 15 | BIG HIT |
| 2 | B | 2 | B | 2 | B | 1 | 15 | |
| 3 | C | 3 | C | 3 | C | 1 | 15 | |
| 4 | D | 4 | D | 4 | D | 0 | 15 | MIDDLE HIT |
| 4 | D | 4 | D | 2 | B | 0 | 15 | |
| 5 | E | 5 | E | 5 | E | 0 | 14 | |
| 5 | E | 5 | E | 2 | B | 0 | 14 | |
| 6 | F | 6 | F | 6 | F | 0 | 10 | |
| 6 | F | 6 | F | 2 | B | 0 | 10 | |

FIG. 19

| | LINE 1 | | LINE 2a | | LINE 2b | | LINE 3a | | LINE 3b | | ALIGNMENT | |
|---|---|---|---|---|---|---|---|---|---|---|---|---|
| CODE NO. | 1st REEL | 2nd REEL | 1st REEL | 2nd REEL | 1st REEL | 2nd REEL | 1st REEL | 2nd REEL | 1st REEL | 2nd REEL | BIG HIT | MIDDLE HIT |
| 18 | 6(F) | 2(B) | 2(B) | 6(F) | 3(C) | 4(D) | 2(B) | 2(B) | 3(C) | 2(B) | 1 | 0 |
| 19 | 6(F) | 6(F) | 2(B) | 4(D) | 3(C) | 2(B) | 2(B) | 6(F) | 3(C) | 6(F) | 0 | 1 |
| 20 | 6(F) | 4(D) | 2(B) | 5(E) | 3(C) | 6(F) | 2(B) | 4(D) | 3(C) | 4(D) | 0 | 0 |
| 0 | 6(F) | 5(E) | 2(B) | 3(C) | 3(C) | 4(D) | 2(B) | 5(E) | 3(C) | 5(E) | 0 | 0 |
| 1 | 6(F) | 3(C) | 2(B) | 4(D) | 3(C) | 5(E) | 2(B) | 3(C) | 3(C) | 3(C) | 1 | 0 |

FIG. 21

| CODE NO. OF 3rd REEL | WINNING LINE | 1st REEL | 2nd REEL | 3rd REEL | HIT FLAG | | | |
|---|---|---|---|---|---|---|---|---|
| | | | | | BIG | MIDDLE | SMALL | NONE |
| 0 | 1 | 6(F) | 6(F) | 2(B) | | 1 | | |
| 1 | 2b | 2(B) | 2(B) | 2(B) | 1 | | | |
| 2 | 1 | 6(F) | 6(F) | 6(F) | | 1 | | |
| 3 | | | | | | | | 1 |
| 4 | 1 | 6(F) | 6(F) | 6(F) | | 1 | | |
| 5 | | | | | | | | 1 |
| 6 | | | | | | | | 1 |
| 7 | 1 | 6(F) | 6(F) | 6(F) | | 1 | | |
| 8 | | | | | | | | 1 |
| 9 | 1 | 6(F) | 6(F) | 6(F) | | 1 | | |
| 10 | | | | | | | | 1 |
| 11 | 1 | 6(F) | 6(F) | 2(B) | | 1 | | |
| 12 | 1 | 6(F) | 6(F) | 6(F) | | 1 | | |
| 13 | | | | | | | | 1 |
| 14 | 1 | 6(F) | 6(F) | 6(F) | | 1 | | |
| 15 | | | | | | | | 1 |
| 16 | | | | | | | | 1 |
| 17 | 1 | 6(F) | 6(F) | 6(F) | | 1 | | |
| 18 | | | | | | | | 1 |
| 19 | | | | | | | | 1 |
| 20 | 1 | 6(F) | 6(F) | 6(F) | | 1 | | |

SLOT MACHINE WITH RANDOM NUMBER GENERATION

BACKGROUND OF THE INVENTION

The present invention relates to a slot machine, and more particularly it pertains to a slot machine of the type having functions to control the stopping positions of plural series of symbols or indicia each sequentially being displayed and changed.

A slot machine is generally provided with a plurality of reels, on each of the outer periphery thereof a plurality of symbols being depicted with a constant interval between two adjacent symbols. By pulling a start lever after a playing coin is inserted, the reels are initiated into rotation simultaneously with each other. The reels are rotated for a certain time period and are stopped. When a combination of a set of symbols at a winning line coincides with the combination of a set of predetermined winning-prize symbols, coins (including tokens) are ejected, the number of which being determined in correspondence with the degree of difficulty in obtaining the combination. Recently, a television type slot machine has been sold in the market. The slot machine of this character uses a cathode ray tube in lieu of a mechanical reel. The television type slot machine displays a series of symbols which otherwise has been depicted on the mechanical reel, and has no mechanically moving part so that it can advantageously operate quietly. Slot machines are classified into two categories in accordance with the way reels are stopped. In one type, a stop button is provided for each reel for stopping the reel upon depressing the stop button, while in another type, a time duration for rotation of each reel is determined using a random timer, thereby in both cases causing the reels to stop one by one.

Generally, it is required to maintain a definite gain ratio for a game machine for business use, and also it is important to add a function to control the generation of winnings with the gain ratio being retained at a constant value. In a slot machine, coins are paid out when a winning-prize symbol combination is attained. Therefore, a pay-out ratio corresponds to the gain ratio described above. In conventional slot machines, a maximum value (maximum pay-out ratio) which permits the machine to pay out certain numbers of coins has been determined beforehand, and a pay-out ratio at a given time has been calculated from the number of coins inserted and ejected up to that time. Thus, the stopping positions of reels are controlled so as to make the pay-out ratio at a given time coincide with the maximum pay-out ratio. This reel stopping control is dependent upon the pay-out ratio at a given time, so that any one of the predetermined winning-prize symbol combinations cannot definitely be generated with a certain probability. For instance, a slot machine which pays an extraordinarily large number of coins, can seldom make a winning-prize combination, such as a set of symbols "7" aligned in one winning line. Furthermore, in the case of a slot machine having a winning prize combination which results in an extremely large number of coins (dividends), a high dividend is difficult to obtain when a winning-prize combination with a low dividend has occurred with an appropriate ratio. As a result, a slot machine having a nature frequently generating a prize-winning combination with a low dividend, has a low probability to generate a winning-prize combination with a high dividend. Conversely, a slot machine having a nature generating a small number of winnings, has a high probability to generate prize-winning combination with a high dividend. Thus, a distorted nature of each slot machine may positively appear.

OBJECT OF THE INVENTION

It is therefore a principal object of the present invention to provide a slot machine in which all the prize-winning combinations can be generated with a predetermined probability while retaining a predetermined pay-out ratio.

It is another object of the present invention to provide a slot machine as above in which a distorted winning nature of any slot machine is prevented.

It is a further object of the present invention to provide a slot machine as above in which an operation of stopping a reel is carried out naturally without the player causing it.

SUMMARY OF THE INVENTION

In order to achieve the above and other objects and advantages, the present invention classifies winning-prize combinations into a plurality of groups. A random number table memory is provided for storing the kinds of groups, and random numbers. A single random number is selected from among a plurality of random numbers, in order to decide whether a winning can be made to generate or not, and if it is affirmative, to decide which of the groups will be chosen. In accordance with the thus-determined possible winning, the stopping positions of the reels are controlled.

The present invention can be applied to slot machines of the type having either mechanical reels for a cathode ray tube. Moreover, the present invention can be applied to slot machines of the type either in which the rotation of the reel is initiated to stop with a stop button, or in which the reels are sequentially and automatically stopped. Particularly in the latter case, a symbol combination is previously determined, and the reels are controlled to stop so as to obtain the combination. Alternatively, for a slot machine of the type in which the reels are sequentially stopped in accordance with a random timer, a time interval set by the random timer can be considered as a time instant when the stop button is operated. Therefore, the reels can be controlled to stop in precisely the same manner as in a slot machine having stop buttons.

BRIEF DESCRIPTION OF THE DRAWINGS

FIG. 12 conceptually shows a table in which the arrangements of symbols are included.

FIG. 14 conceptually shows a random access memory for storing code numbers, symbol numbers, and the like.

FIG. 15 conceptually shows a winning-prize symbol table.

FIG. 19 shows a reference table which is made up after the second reel has been stopped.

FIG. 21 is a hit flag set-up table which is made up after the second reel has been stopped, by checking for each code number of a third reel.

DETAILED DESCRIPTION OF THE PREFERRED EMBODIMENT

Figure 1:
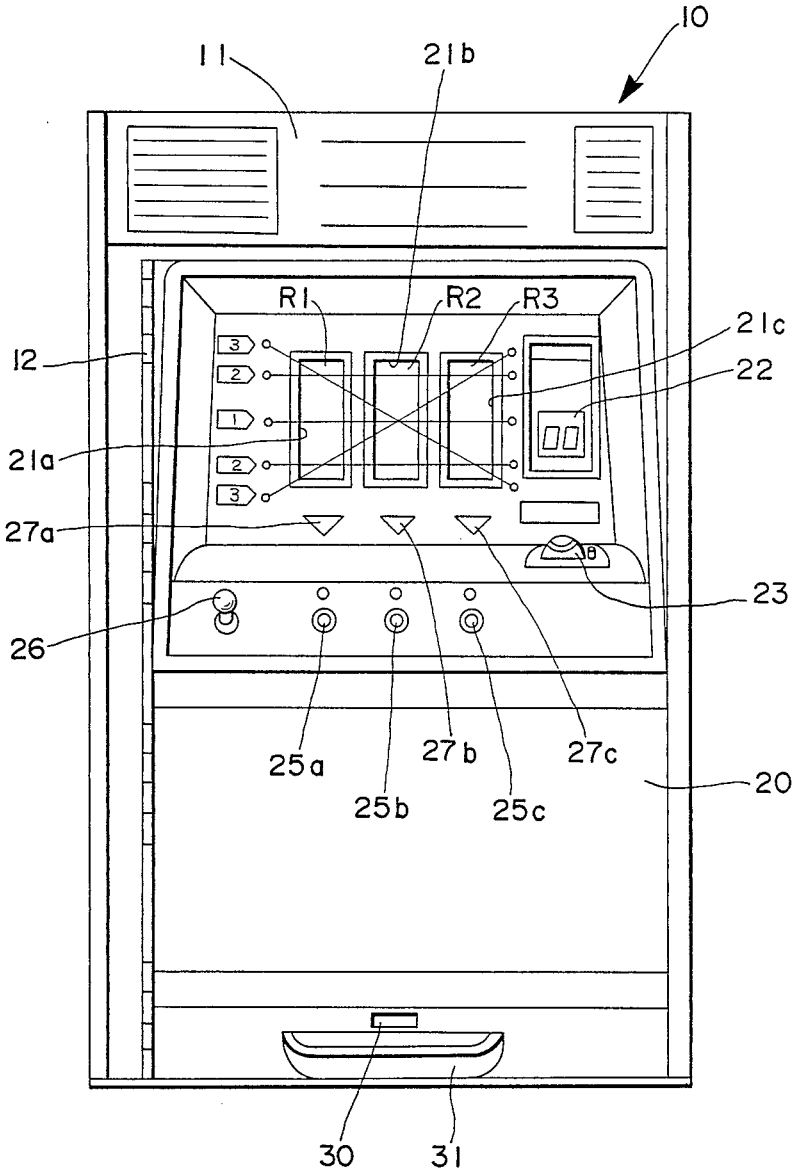
FIG. 1 is a front view from the outside showing illustratively one example of a slot machine according to the present invention.

Referring to FIG. 1, a display panel 11 is provided on the upper side of a main body 10. On the display panel 11, there are shown winning-prize combinations and a dividend table explaining the number of coins to be ejected in accordance with the winning-prize combination. A front door 20 can be opened or closed with respect to the main body to which it is coupled through a hinge 12. The front door 20 is provided for the purpose of accessing the interior of the main body 10, when an adjustment of the parts housed in the main body 10, a check for a counter which counts the number of coins inserted, or a collection or replenishment of coins, is required. The front door 20 is provided with windows 21*a* to 21*c* for each reel R1 to R3, sufficiently large in size for viewing three symbols depicted on an outer periphery of each reel through respective windows. Furthermore, there are provided on the front door 20 a digital display section 22, a coin insertion slot 23, stop buttons 25*a* to 25*c*, a start lever 26, a coin ejection outlet 30, and a saucer 31. The digital display section 22 displays the number of coins to be ejected, when a prize-winning symbol combination is attained. The number shown on the digital display section 22 is decreased by one every time a coin is ejected through the coin ejection outlet 30 into the saucer 31. A maximum of three pieces of coins may be inserted into the coin insertion slot 23 prior to starting a game. Stop lamps 27*a* to 27*c* are respectively provided for each reel R1 to R3, turning on when the corresponding reel R1 to R3 reaches a predetermined rotation speed after the start of rotation, and turning off when the corresponding stop button 25*a* to 25*c* is pushed. After insertion of a coin or coins, the reels R1 to R3 start to rotate simultaneously with the pulling of the start lever 26.

Figure 2:
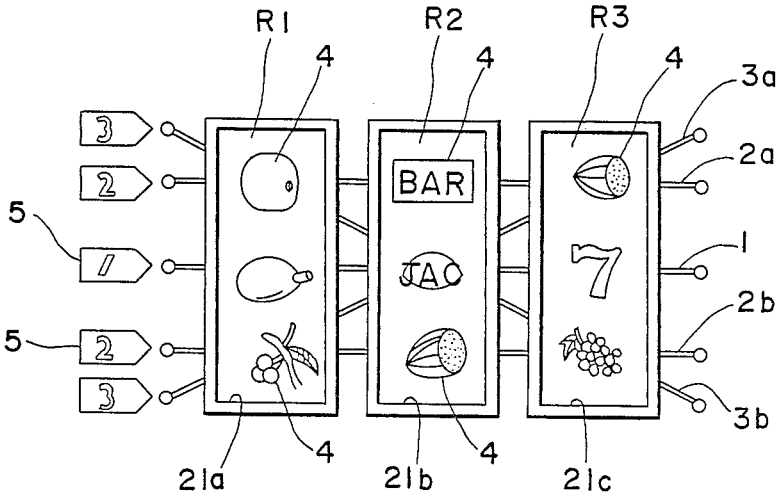
FIG. 2 schematically shows a portion of a reel window of FIG. 1.
Figure 3:
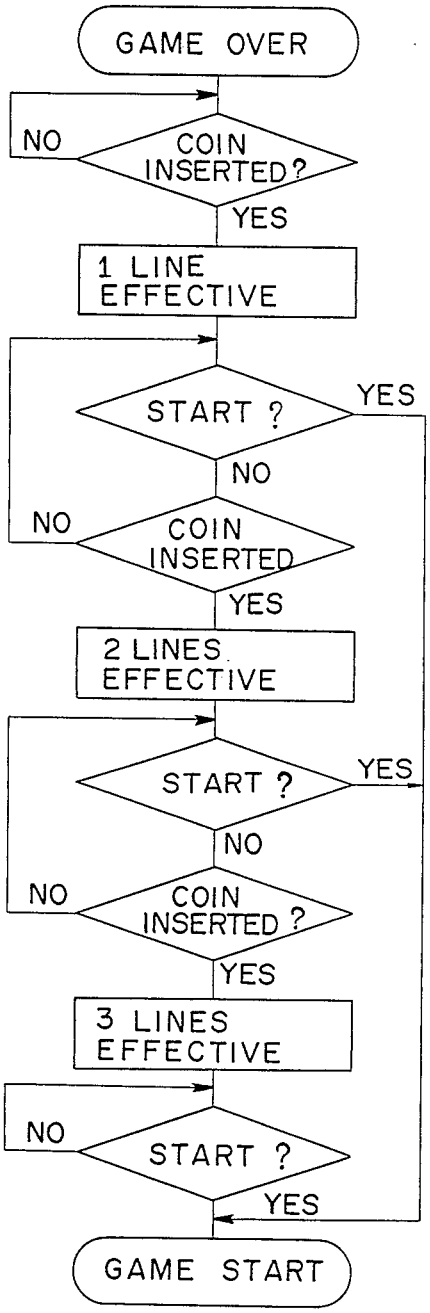
FIG. 3 is a flow chart illustrating a decision processing for effective winning lines.

FIG. 2 shows in detail the windows for viewing the reels of the slot machine shown in FIG. 1. In the slot machine, the number of prize-winning lines can be selected in accordance with the number of coins inserted prior to the start of a game. In more detail, referring to FIG. 2, wherein three symbols 4 for each reel R1 to R3 can be seen through the respective windows 21*a* to 21*c*. When a single coin is inserted, line 1 only can be considered as effective in judging a winning. When two coins are inserted, the line 1, and lines 2*a*,2*b*, three lines in all, can be considered as effective. When three coins are inserted, additional two lines 3*a*, 3*b*, five lines in all, can be considered as effective. Lamps 5 display the number of effective lines corresponding to the number of coins inserted. The selection of the number of winning lines is determined by the number of coins to be inserted prior to the operation of the start lever 26. This selection can be made in accordance with a flow chart shown in FIG. 3, wherein the insertion of a coin or coins is detected as an electronic signal with a micro switch or a photo sensor, and a judgement proceeds as to whether the start lever 26 has been actuated or not.

Figure 4:
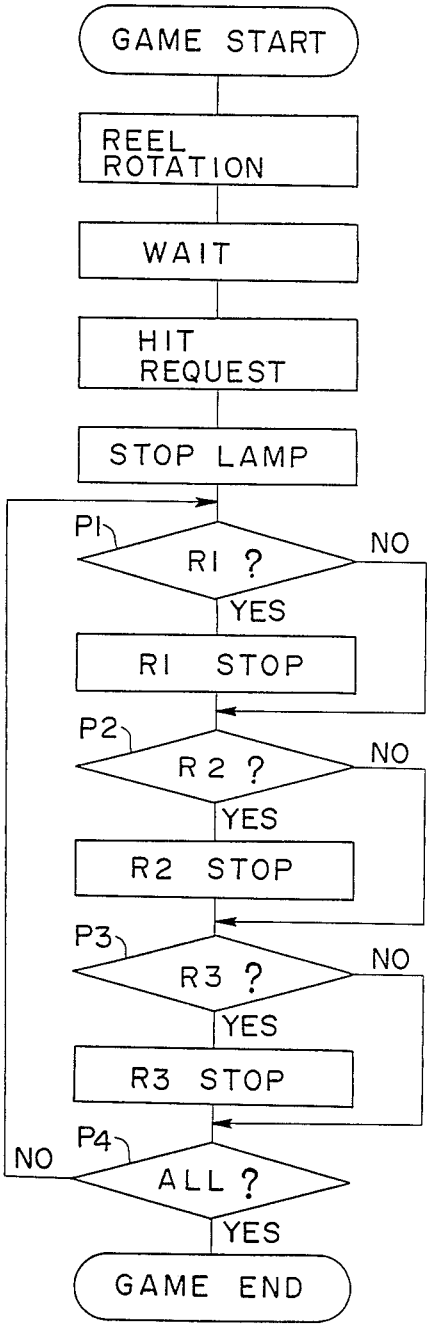
FIG. 4 is a flow chart illustrating a basic flow of a game carried out with a slot machine according to the present invention.

A fundamental processing after the decision of the number of prize-winning lines is carried out in accordance with a flow chart shown in FIG. 4. Upon actuation of the start lever 26, the three reels R1 to R3 are initiated into rotation. After setting a hit request described hereinafter (referring to the absence or presence of any winning) after the lapse of a predetermined time, the operation of the stop buttons 25*a* to 25*c* is brought into an enabling state for stopping the reels, and the stop lamps 27*a* to 27*c* are illuminated for indicating such a state. In each judging processing P1 to P3 shown in FIG. 4, the stop buttons 25*a* to 25*c* for the respective three reels R1 to R3 are checked as to whether they are pushed or not. The following description is made assuming that the reels R1, R2, and R3 stop sequentially in this order. However, in practice, any one of the reels, for example, the reel R2 can be stopped first, and the reel R1 can be stopped last. Note that the order of stopping of the reels R1 to R3 can be chosen to start from any one of them. When all of the reels R1 to R3 are judged at the judgement step P4 to have stopped, a flow chart shown in FIG. 5 is executed thereafter.

Figure 5:
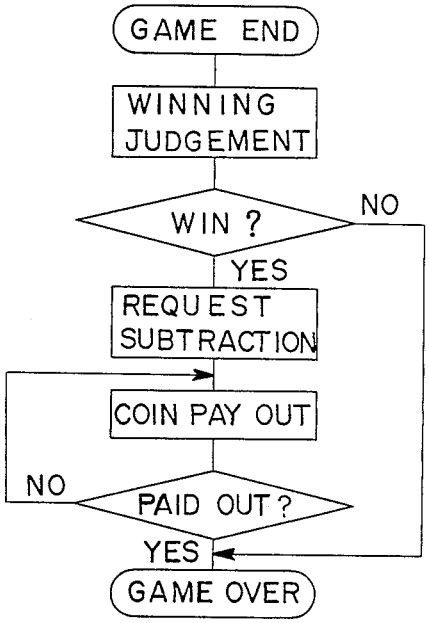
FIG. 5 is a flow chart illustrating a fundamental processing, commencing from the stopping of the reels and terminating at a game-over.

FIG. 5 is a flow chart for processing a winning judgement and for executing a coin pay-out. For the purpose of judging a winning, an electrical signal indicative of each symbol 4 of the reels R1 to R3 is obtained by reading with a photo sensor a photo-electric signal section provided on each symbol 4 of the reels R1 to R3. Alternatively, in the case of a slot machine in which the reels R1 to R3 are driven by pulse motors, a light shielding portion is provided on a suitable location of each reel in order that a reset pulse can be obtained every full rotation of the reel. Thus, a particular symbol 4 is traced, by detecting the number of pulse signals supplied to each pulse motor, counting from the beginning of generation of the reset pulse until the corresponding reel stops. In judging a winning, a combination of the above coded signals for each symbol 4 of the reels R1 to R3 is referred to and compared with a read-only memory (ROM) described later. When a winning occurs, a request subtraction processing is performed, and a hopper for paying out coins is driven. The number of coins being paid out is counted by a coin counter provided such as on a coin pay-out passage. When the counted number reaches a preset number, the game is over.

Figure 6:
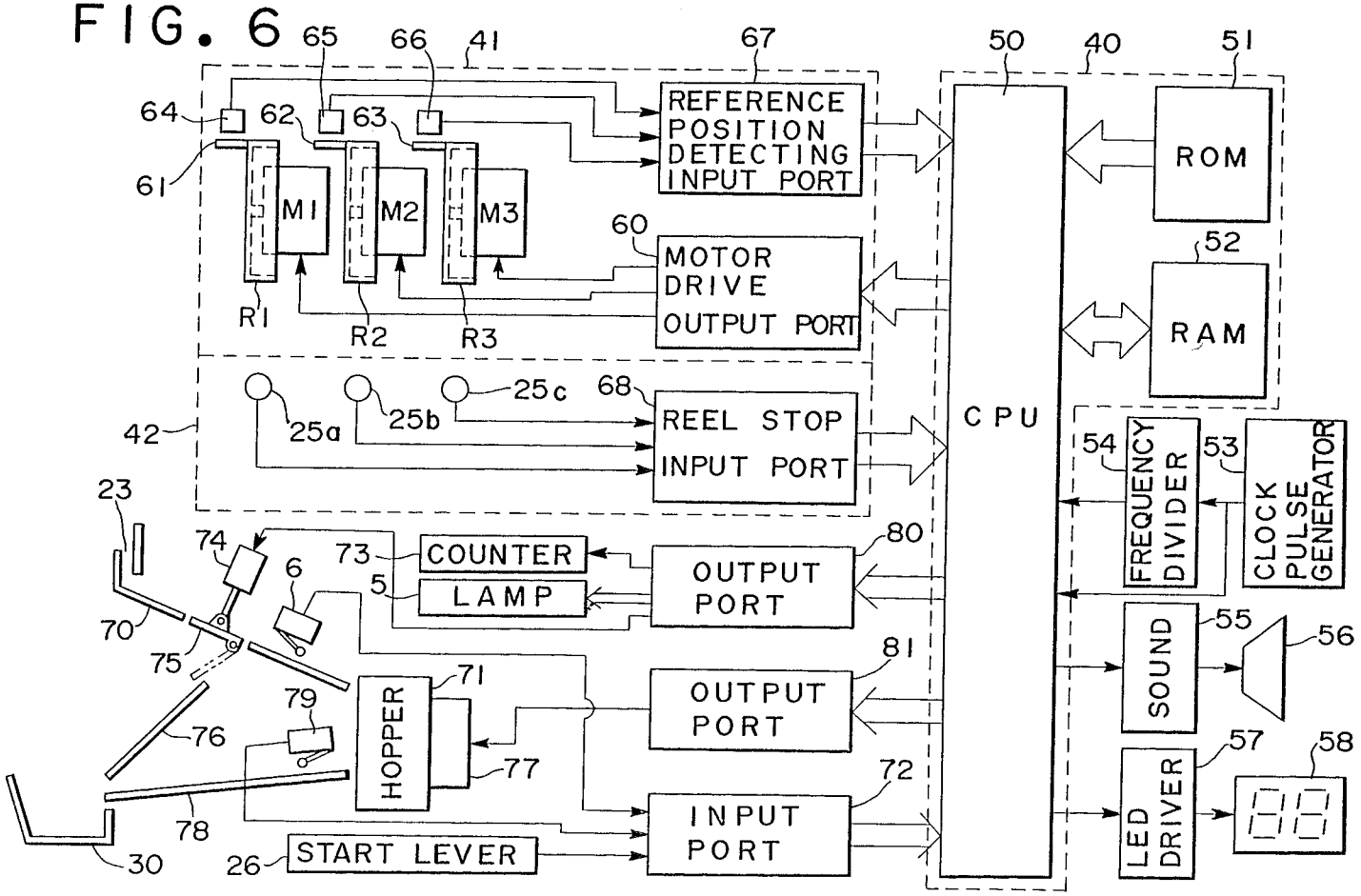
FIG. 6 is a system block diagram illustrating one example of a slot machine according to the present invention.

FIG. 6 shows an electrical circuit diagram of a slot machine according to the present invention. In the figure, a broken-lined block 40 is a main control section including a CPU 50, a ROM 51 (Read-only Memory), and a RAM 52 (Ramdom Access Memory). The ROM 51 stores a reference table, a coin number table, a winning proability table, and the like. The reference table stores information on a relation between the symbols 4 and their symbol codes. The coin number table stores information on the symbol codes for a winning, and the number of coins to be paid out in correspondence with the winning. The winning probability table stores information on a hit request with which the amount or degree of winning is decided when there is a win. The RAM 52 has various specific memories, such as, a memory for temporarily storing random numbers sampled after the start of a game, a memory for storing a hit request count, a memory for temporarily storing the code numbers of the reels R1 to R3, and a memory for storing other data such as symbol numbers, which is described later. A clock pulse generator 53 generates for example 4 MHz pulses which are used as reference pulses for making the CPU 50 operate under the control of the reference pulses. A frequency divider 54 supplies for example 500 Hz pulses to the CPU 50 in order that a particular program should be executed with interruption. A sound generator 55 drives a loudspeaker 56 to generate a sound therefrom after a suitable time lapse from the start of a game, so that playing the game becomes more interesting. A light emission diode driver 57 drives for example seven segment digital display light emission diode 58, and is used for displaying the number of coins to be paid out, or other information. A broken-lined block 41 is used when monitoring reel drive conditions. In the present embodiment, reels R1 to R3 are driven by the respective pulse motors M1 to M3. A motor drive output port 60 supplies each pulse motor M1 to M3 with a drive pulse to thereby drive the reels R1 to R3. The reels R1 to R3 are formed on a part thereof with light shield portions 61 to 63. The light shield portions 61 to 63 are detected with light sensors 64 to 66 so as to generate reset signals for resetting respective counters which count drive pulses supplied to each reel. The reset signal is transferred into the CPU 50 through an input port 67. The rotative position of each reel R1 to R3 is detected by counting the number of pulses supplied to each pulse motor M1 to M3 after the reset signal is generated. In practice, a ripple counter is provided for generating a pulse when a suitable number of pulses for shifting the symbol 4 by one frame is input to the ripple counter. The output of the ripple counter is counted with another counter coupled thereto. In this manner, a particular symbol located just upon a winning line can be identified. This is because the order of arrangement of symbols on the reel has previously been set out. Therefore, in addition to the particular symbols on the winning line, other symbols following the symbols on the winning line on the reel can also be identified. A broken lined block 42 is a stop operation block. The depression of each stop button 25*a* to 25*c* generates a stop signal, which is input though a reel stop input port 68 to the CPU 50.

A coin inserted into the coin insertion slot 23 passes through a chute 70 into a hopper 71. The coin passing downstream on the chute 70 is detected with a switch 6 to generate a signal, which is transferred through an input port 72 to the CPU 50. The CPU 50 instructs an electromagnetic counter 73 to count up the contents thereof every time a coin is inserted, thereby enabling the ramp 5 to display the number of coins having been inserted. The CPU 50 further instructs the illumination of the lamps 5 shown in FIG. 2, which display the number of effective winning lines in accordance with the number of coins having been counted. If the number of coins inserted reaches three, then the CPU 50 instructs the driving of a solenoid 74 (FIG. 6) to move a gate 75 to the position shown by a double dotted line. Thus, a coin inserted after that time is returned to the saucer 31 through a chute 76. The hopper 71 is driven with a motor 77 to drop the coins accommodated therein one by one into a chute 78, and into the saucer 31. These paid out coins are detected with a switch 79 provided on the outlet of the hopper 71. Reference numbers 80, 81 represent output ports, respectively.

Figure 7:
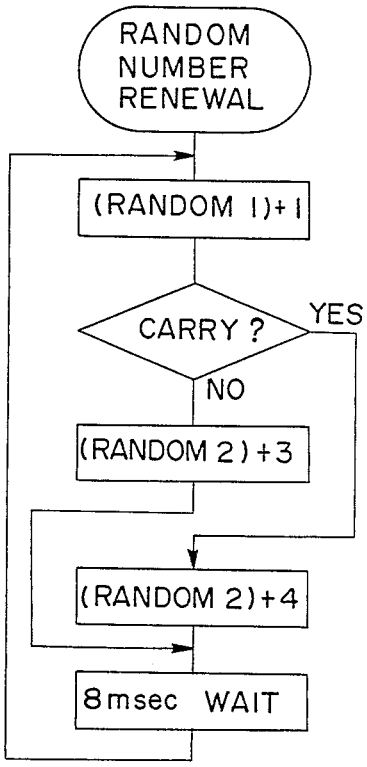
FIG. 7 is a flow chart illustrating a renewal of random numbers.
Figure 8:
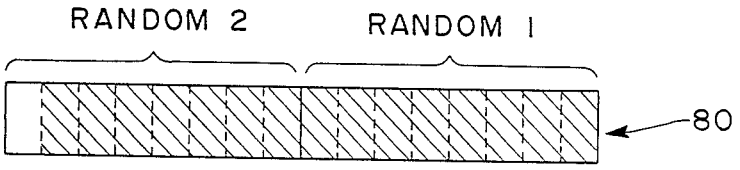
FIG. 8 conceptually shows a random access memory for storing random numbers.

Next, the generation of a hit request will be described in detail, which is one of the features of the present invention. The generation of a hit request is obtained as a result of the reference of the random number sampled at the start of a game, as described previously, to a group of numbers representative of a winning and stored in the winning table of the ROM 51. FIG. 7 is a flow chart showing a renewal of random numbers. Upon turning on a main power switch of the slot machine, the machine is enabled to start a game. A timer interruption processing is executed, for example, every 2 msec, in accordance with the output from the frequency divider shown in FIG. 6. In this case, the renewal of random numbers is carried out every four interruptions, that is, every 8 msec. Upon generation of random numbers as shown in FIG. 7, the random numbers are sequentially registered into a two bytes RAM 80 schematically shown in FIG. 8, which constitutes a part of the RAM 52. The random number RAM 80 is constructed of a one byte memory RANDOM 1 and a one byte memory RANDOM 2, which makes a two bytes arrangement in total. If 15 bits, as shown by oblique lines in FIG. 8, are employed as a working area, the scope of random numbers covers "0 to 32764" in decimal notation. The capacity of the working area of the random number RAM 80 is selectively determined in a manner suitable for a setting of the winning probability. As can be seen from the flow chart of FIG. 7, the random number renewed every 8 msec is processed during the steps "+1", "+3", or "+4" to add a prime number of "769" in decimal notation to the previosly obtained random number. Therefore, a random number is generated and renewed at the random number RAM 80, without repeatedly generating a random number of the same value. Random numbers within a preset scope are cyclically generated and repeated one after another. The renewal range at the time of renewal is determined by a prime number "769" due to the steps "+1", "+3", or "+4" shown in the processing flow in FIG. 7. However, the value of the number is not limited thereto, and theoretically any prime number can be used.

Figure 9:
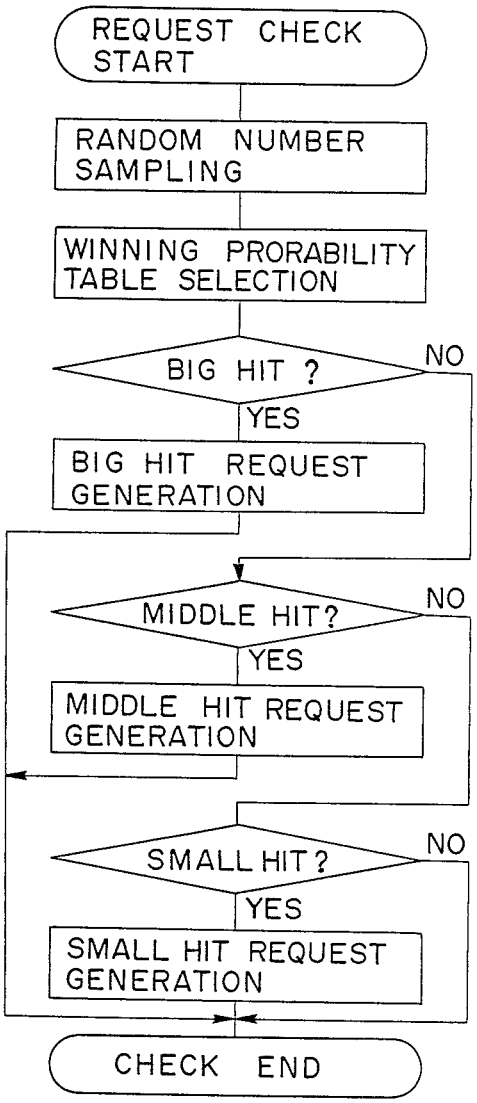
FIG. 9 is a flow chart for a hit request check.

FIG. 9 is a flow chart explaining random number sampling and hit request check processings. This flow chart corresponds to the "hit request" processing in the flow chart shown in FIG. 4. After the start of a game, that is, for example, after the operation of the start lever 26, upon generation of a timing signal after a certain time delay (at this time instant, it is preferable that each reel R1 to R3 be at an ordinary rotation speed), the random number presented in the random number RAM 80 at that time instant is determined as a random number to be used in the game. The random number thus determined is referred to or compared with, in accordance with the flow chart of FIG. 9, the winning probability table described later in detail. If the random number has a value corresponding to the big hit, then a big hit request signal is generated. If the random number has a value corresponding to the middle hit, then a middle hit request signal is generated. And a small hit request signal is generated in a similar manner. Thus, any one of the hit request signals is generated, or otherwise it is checked that there is no hit request signal. As to a "winning probability table selection" processing, there are provided beforehand three kinds of winning probability tables, since the effective winning lines vary with the number of coins inserted before the game starts. The selection processing means selects one of the three winning probability tables in accordance with the number of coins inserted.

Figures 10, 11:
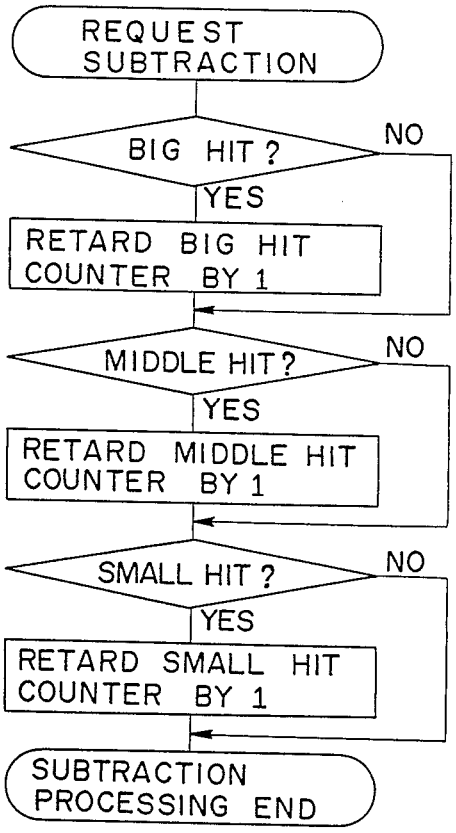
FIG. 10 conceptually shows a winning-prize probability table.
FIG. 11 is a flow chart illustrating a subtraction processing for a request counter.

FIG. 10 conceptually shows the winning probability table. B1 to B3, M1 to M3, and S1 to S3 to each line of the table represent numerical values preset empirically, and correspond to the two bytes random number shown in FIG. 8. The lines are selected in accordance with the number of coins inserted (this processing corresponds to the "winning probability table selection" processng in the flow chart of FIG. 9). Each numerical value on the line is commonly set as $B<M<S$. It is assumed here that the value of the random number generated in FIG. 7 falls within the range of 0 to N. If the number of coins inserted is "1", then the probability for the big hit is B1/N, the probability for the middle hit is M1/N, and the probability for the small hit is S1/N. Further assuming that B1 is 100, M1 is 500, and S1 is 1000, if the sampled random number falls smaller than 100, then a big hit request is generated. Similarly, if the random number sampled falls 100 up to 600, then a middle hit request is generated. If the number falls 600 up to 1600, then a small hit request is generated. If the number is equal to or exceeds 1600, then no hit request is generated. In other words, the winning probability table has a function to determine the probability of winning.

After the start of a game and at a certain time delay therefrom, a particular random number is sampled, as described above, and the particular random number is referred to the aforesaid winning proability table in order to obtain, if any, a hit request. In this case, aiming at obtaining a constant pay-out rate, a request counter can be employed. The request counter for counting each hit request counts up by "1" when the hit request described above is generated, and the counted results are stored in a RAM. If there is a hit or winning, the request counter counts down by "1". If there is no hit, the contents of the request counter is retained as it is. Thus, until the contents of the request counter becomes 0, a hit request can be generated to thereby maintain the pay-out rate constant. This processing is carried out for example in accordance with a flow chart of FIG. 11.

The contents of big, middle, and small hits can be decided as desired. For example, at the bit hit, 15 coins are paid out and a bonus game is made available following the pay-out, and at a middle hit, 10 to 15 coins are paid out, and at a small hit, 2 to 5 coins are paid out. Illustratively, at the bonus game, one of the reels is rotated at a low speed upon insertion of a coin, and if a certain symbol such as "JAC" on the reel appears, then 15 coins are further paid out. This bonus game may be repeated several times in the same manner.

The preceding description has been made with respect to the generation of a hit request. Next, a stop control for reel rotation following the generation of the hit request will be described. A reel drive convenient for this end is preferably a pulse motor. Since the reel is rotated by a definite angle upon reception of one pulse to the pulse motor, a pulse motor of the nature that 1.8 degree advance is attained by a single pulse, can have a single rotation with 200 pulses supplied thereto. And if the reel bears 21 symbols 4 thereon, the reel is rotated by one symbol or frame upon reception of $200/21=9.523\ldots$ pulses, that is, 9 to 10 pulses. As previously mentioned, a light shield portion is provided on a periphery of the reel. The 21 symbols are respectively given code numbers "0 to 20", sequentially in the order of rotation direction starting from the symbol located at the light shield portion or reset position. The 21 code numbers, and symbol numbers corresponding to the respctive symbols for the code numbers, are stored in the ROM 51. Therefore, under control of the main control section 40, a code number is calculated by counting the number of pulses sent to the pulse motor after its reset, and the calculated code number is referred to the ROM 51, in which the code numbers and symbol numbers are stored, thereby enabling the identification of a particular symbol appearing in the window. It is to be noted that if the light sensor is displaced to some extent from the window position, a suitable number of pulses are adjusted in order to compensate for the angle of rotation corresonding to the displacement.

With the arrangement described above, at the time instant when each stop button 25*a* to 25*c* of the respective reels R1 to R3 is depressed, the number of delievered pulses having been monitored after the generation of the reset signal, can be referred to the previously mentioned symbol number table. Thus, a particular symbol appearing in the window at the same time instant can be identified. It is assumed here that the reel is controlled to stop during the time until the reel completes another rotation after the actuation of the stop button. Any symbol mark as desired can be controlled to stop at the window by adjusting the number of pulses to be supplied after the time instant of the actuation of the stop button, with the consideration of the number of pulses delivered to the pulse motor from the time the reset signal was generated to the time the stop button is actuated. It is to be noted from the above description that any combination of symbols of the three reels can be freely set, by allowing each one of the three to stop in a similar manner as above. The setting of desired combination of symbols can be effected employing the function of the hit request generation described above, and a slot machine can be fabricated, of the fundamental type which is operated in accordance with a so-called random number sampling, and in accordance with a reference to a winning table.

If the reel is controlled to stop after a considerable time lapse from the actuation of the reel stop button (or from the start of reel rotation), the player may feel it artificial. Therefore, in the present preferred embodiment, the above-mentioned fundamental type slot machine has been modified such that the reel is controlled to stop within a predetermine limited time after the actuation of the stop button, and that the reel is controlled to stop, with a combination of symbols according to the generated hit request.

It is generally known in the art that the movement of the symbols up to four frames after the actuation of the stop button does not give an unnatural impression to the player when the ordinary pulse driven type slot machine is used, although it is dependent on the rotation speed of the reel. In the present embodiment, therefore, in addition to the symbol identified from the reel position at the time of the actuation of the stop button, four symbols following the symbol, totaling five symbols in all, are checked as to identity. If a symbol necessary for completing a combination of symbols corresponding to a hit request previously set up is included among the five symbols, the reel is controlled to stop at that symbol within the five symbols. This control processing is carried out for each of the three reels.

FIG. 12 conceptually shows a symbol arrangement table.

Figure 13:
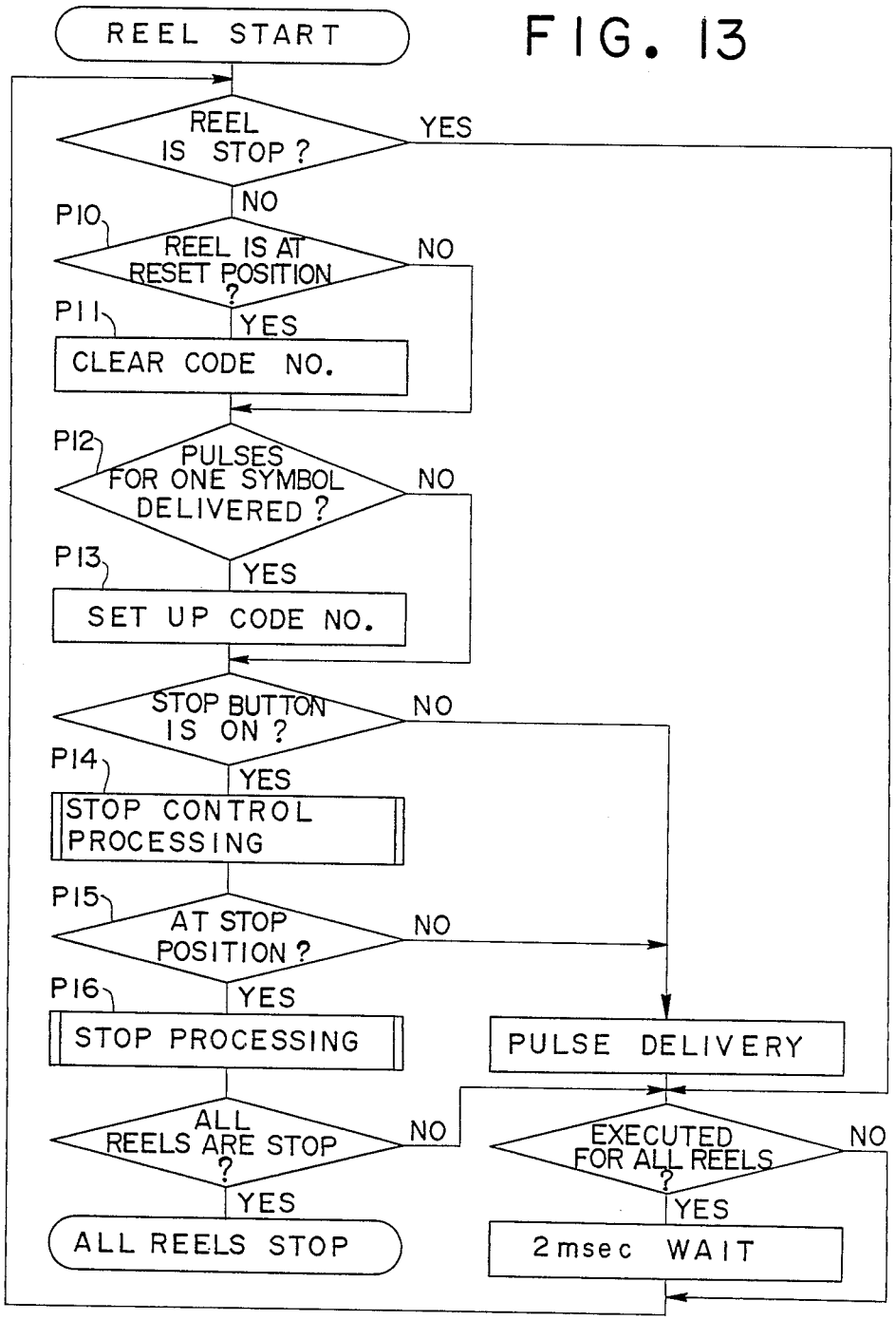
FIG. 13 is a flow chart illustrating a fundamental processing for reels.

FIG. 13 is a flow chart illustating a reel stop processing. The symbols shown in FIG. 12 are not present in practice in the ROM 51. However, the symbols are shown in the figure in order to indicate a reference relation to the symbol numbers (similar in the case of FIG. 14, FIG. 15, and FIG. 19). These symbols are depicted using alphabetical characters, for the purposes of simplifying the drawings. The correspondence between the alphabetical characters and the symbols practically used is as follows:

A: 7, B: BAR, C: WATERMELON, D: GRAPE, E: PLUM, F: ORANGE, G: CHERRY, H: LEMON

The code numbers "0 to 20" and symbol numbers "1 to 8" for each reel are stored in the ROM 51 using binary notation. It is sufficient for the code number to have 5 bits, and for the symbol number to have 3 bits. The flow chart shown in FIG. 13 illustrates a flow carried out for each one of the three reels. First, the flow begins with the actuation of the reel start lever. In the processings represented by P10, P11 in FIG. 13, the code number "0" is detected, that is, the light shield portion mounted on the reel is detected, and the memory is cleared to 0 which memory renews the code number sequentially with the reel rotation. In the processings represented by P12, P13, a new code number is set up in the RAM storing the above code number, after it is confirmed that the pulses (9 to 10 pulses) required for one symbol or frame movement have been supplied to the motor. In the processing of stop control P14, a symbol for completing a combination according to the hit request generated is checked using the code numbers thereof whether it is included within the four symbols described previously and whether it is present at the time of the stop button actuation. If it is present, the number of pulses to be delivered further to the motor is calculated. In the prcessing P15, the calculated number of pulses are counted until the same number of pulses are supplied to the motor. Thereafter, the reel is stopped. In the processing P16, the code number and symbol numbers are referred to each other. Similar processings are carried out for every reel.

FIG. 14 shows an arrangement of a RAM area (a portion of the RAM 52) the contents of which are made up every time the P13 processing is executed. In FIG. 14, a RAM 1 is alterable in contents with the processing P13. For example, at a certain time constant, the code number for each reel R1 to R3 appearing at the center line 1 of the reel window is set up, as illustratively shown in the figure. After the set-up of the code number for each reel, three symbol codes (symbols) for each reel appearing in the reel window can definitely be determined by referring to the ROM 51 in which the table shown in FIG. 12 is stored. The results are set up, as shown in the figure, into a RAM 2. After the contents of the RAM 2 are determined as above, an array or series of symbols aligned along each winning line 1, 2*a*, 2*b*, 3*a*, 3*b* of FIG. 2 is determined, respectively, and is stored in a RAM 3 as shown in the figure. The combination of symbol codes on each line is referred to the winning symbol table, wherein winning combinations of symbol codes, the number of coins to be paid out for the winning combination, and the presence or absence of the bonus game are stored. FIG. 15 conceptually shows one example of the winning symbol table. The reference to the winning symbol table can be made only with respect to the winning line 1, if the number of coins inserted is one. Here, the number of coins inserted is assumed to be three. If there is a middle hit on the line 3*b* having a combination of symbol codes "5(E)-5(E)-5(E)" and paying out 10 coins, the contents of a RAM 4 are set up as shown in FIG. 14. In the area 4*a* of the RAM 4, the presence or absence (0 or 1) of a bonus flag, which means whether a bonus flag is generated or not, is stored. In a RAM 5, a big hit area 5*a*, a middle hit area 5*b*, a small hit area 5*c*, and a no hit area 5*d* are provided each for setting up a flag in accordance with the kind of hit obtained or not obtained. In the FIG. 15, "ANY" means that any symbol can be available.

The rotation of the three reels can be stopped in the order the player desires. The stop processing for each reel will be described, assuming that the reels are stopped in the order of the first, second, and third reels (the first, second, and third reels, that is, reading from the left in FIG. 2), and that the number of coins inserted is three.

(1) PROCESSING FOR THE FIRST REEL

Figure 16:
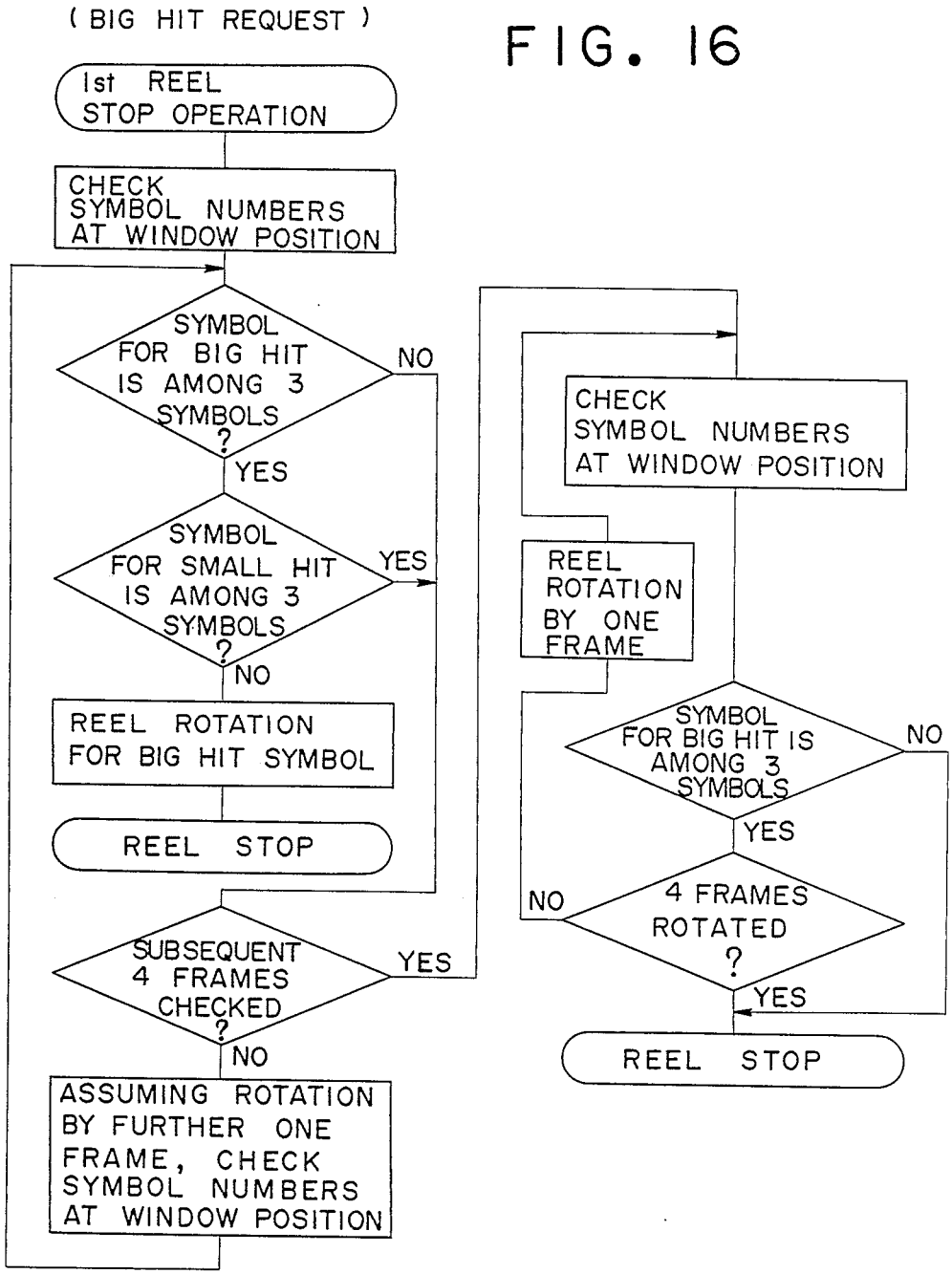
FIGS. 16 and 17 respectively show flow charts illustrating a stop processing for a first reel.

In the case that there is a big hit request, the flow chart shown in FIG. 16 is followed. In accordance with the data stored in an area for the reel R1 of the RAM 1 (refer to FIG. 14) at the time when the stop button is operated, the symbols of the reel are checked within a range of four frames displacement. If there is a symbol enabling the completion of a big hit within this range, then the number of pulses to be sent to the motor is adjusted such that the symbol can be seen through the reel window. In the flow chart, "within 3 symbols" or "symbol numbers at window position" refers to three symbols or symbol numbers appearing at the window position. This is because three coins have been inserted, and all the winning lines have been made effective. The three symbol numbers at the window position can be obtained from the symbol numbers stored in the RAM in FIG. 14.

Figure 17:
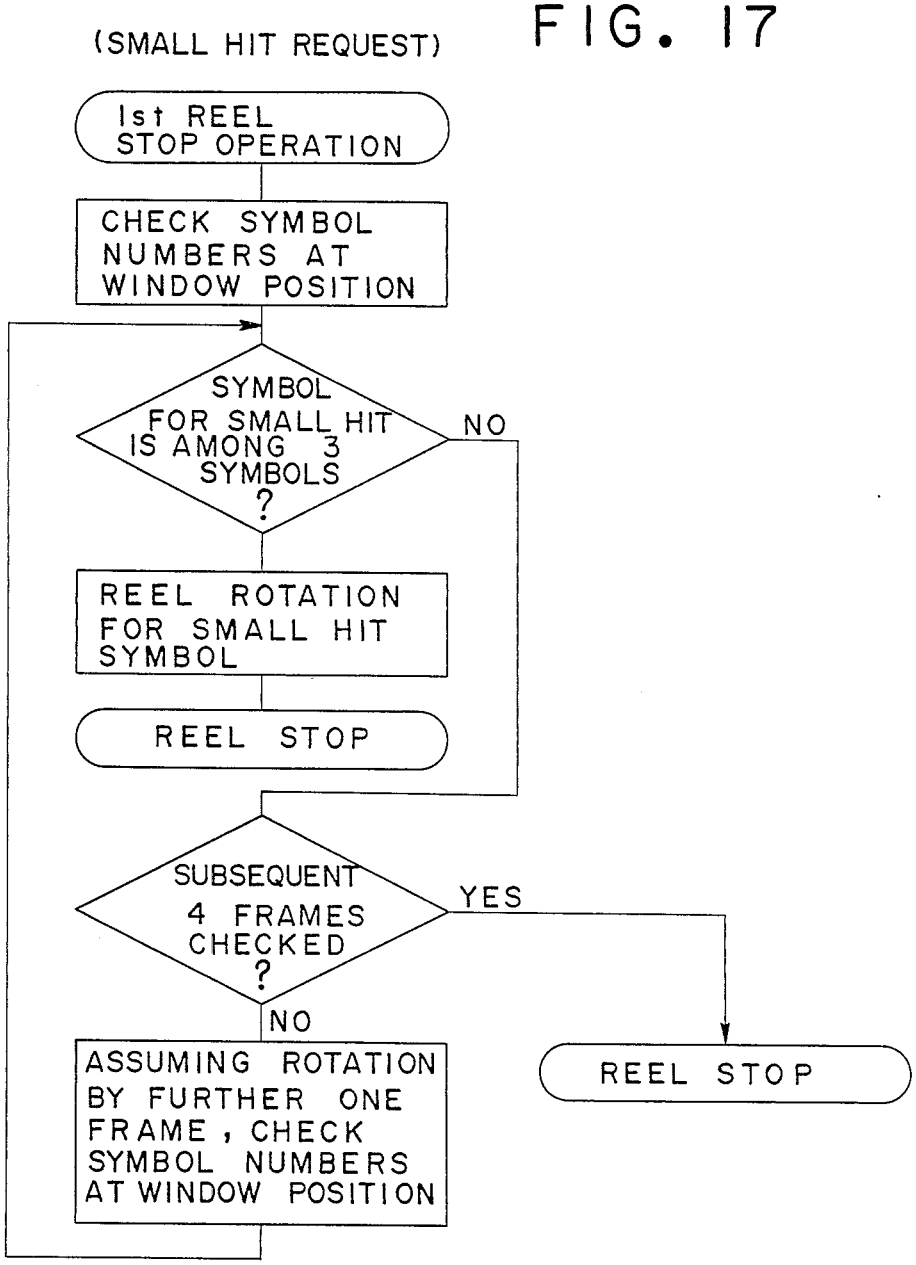

In the case that there is a middle hit request, a similar processing proceeds with the flow chart of FIG. 16, in which the "big hit" step is replaced by the "middle hit" step. In the case that there is a small hit request, the flow chart of FIG. 17 is used in order to proceed with a processing. If there is a symbol for a small hit within the subsequent four frames, the adjustment is made to make the symbol appear at the window position. If there is a no hit request, the first judgement step in the flow chart of FIG. 17 is considered as "no symbol for a small hit within three symbols", following the check step for subsequent four frames. If there is no symbol for a small hit within the subsequent four frames, the reel is stopped at that position. This means that any symbol for a big or middle hit is controlled in order to appear at the window position.

In the above processings, if any suitable symbols can be brought into the window position, then a processing which means that a no hit request is present, is executed. This processing is especially ready to occur only for a small hit request. More particularly, the reason is that a small hit is generally obtained merely by the appearance of a particular symbol on the first reel R1, and the number of symbols for a small hit borne on the first reel is commonly of the order of only 2 to 3 (alternatively, the remaining symbols borne on the first reel R1 are usually symbols for a big hit or a middle hit).

When the first reel R1 stops, the symbol numbers are stored in an area for the first reel R1 in the RAMs 2 and 3 of FIG. 14, with reference to the symbol table shown in FIG. 12.

(2) PROCESSING FOR THE SECOND REEL

Figure 18:
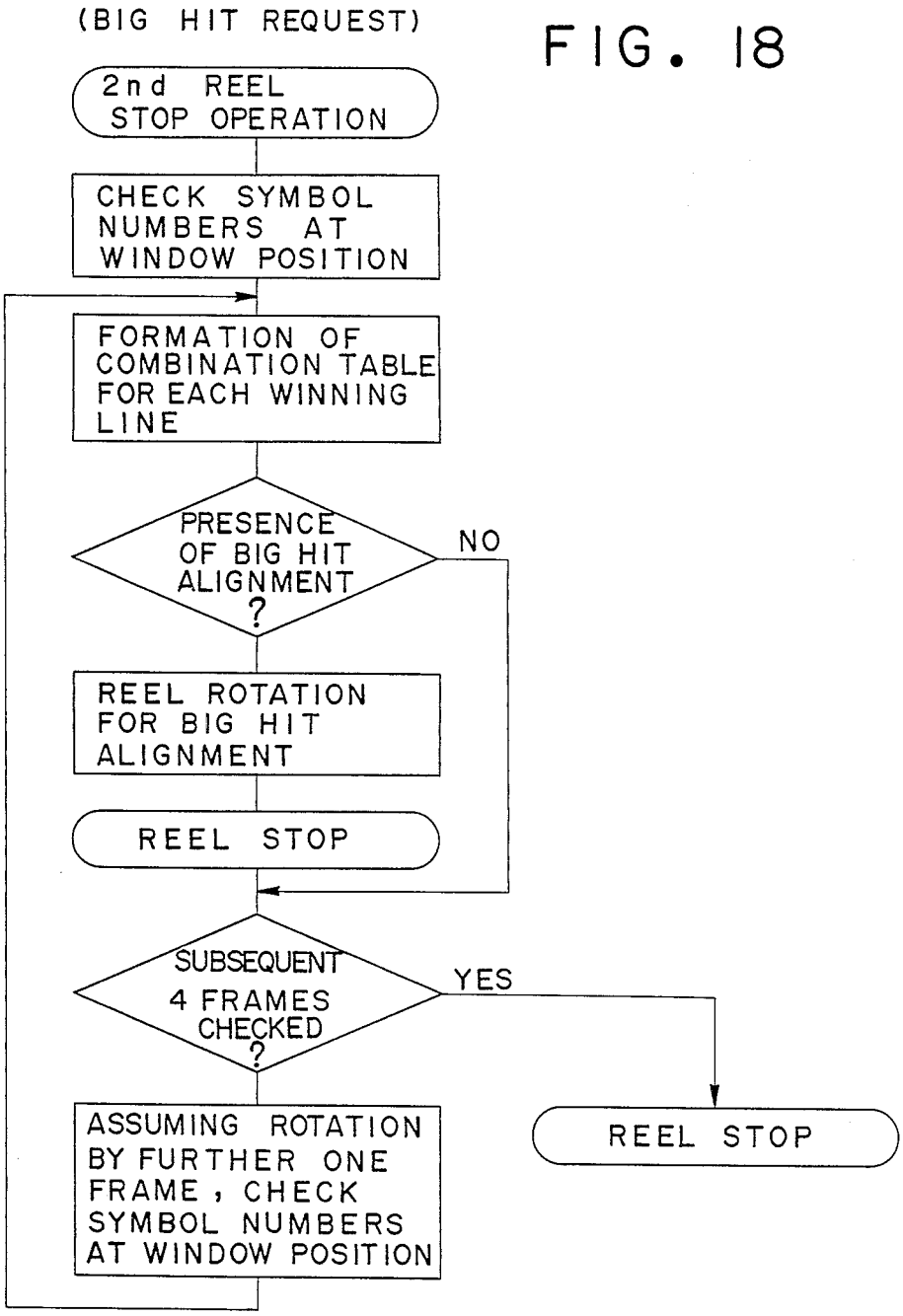
FIG. 18 is a flow chart illustrating a stop processing for a second reel.
Figure 20:
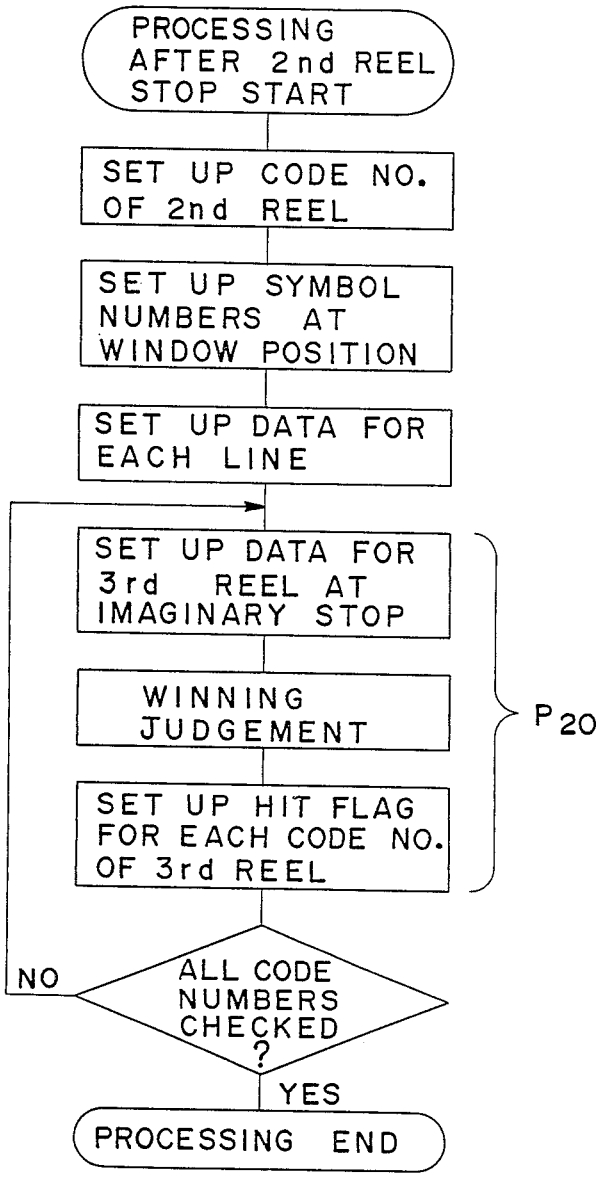
FIG. 20 is a flow chart illustrating a processing after the second reel has been stopped.
Figure 22:
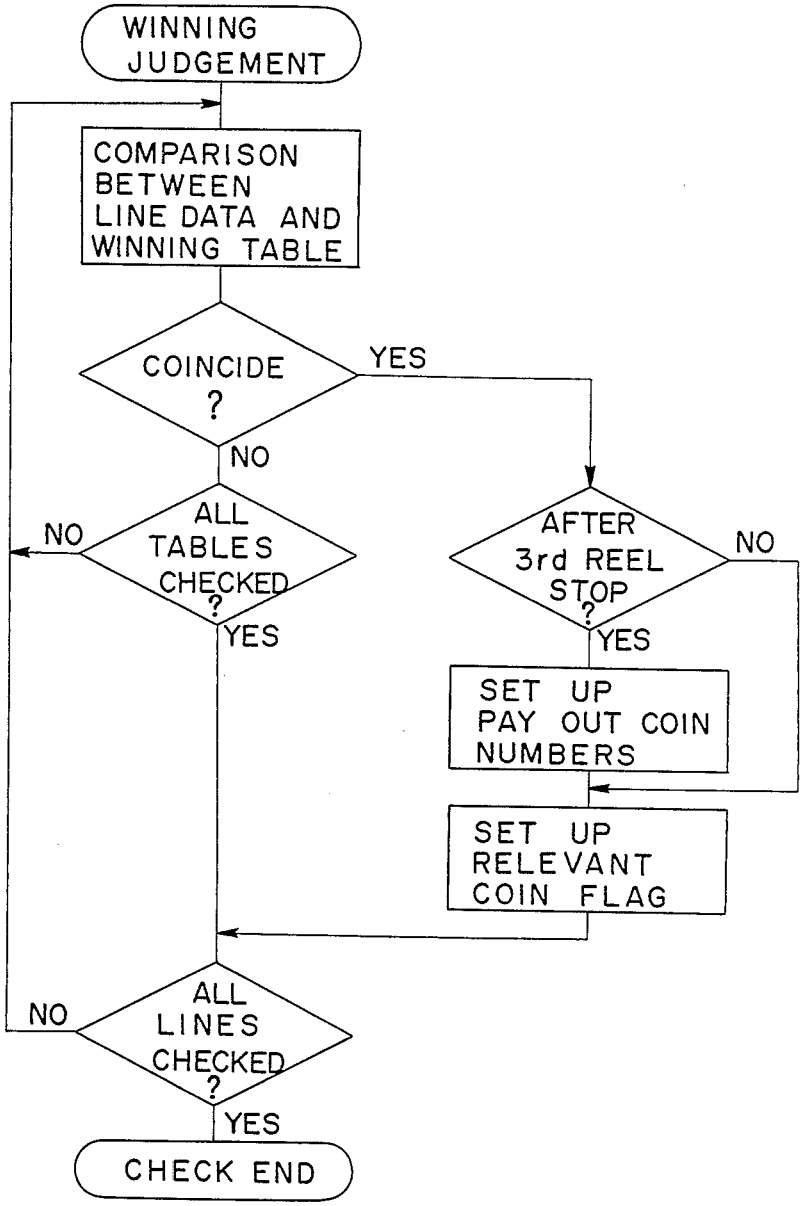
FIG. 22 is a flow chart illustrating a processing for a hit flag set-up.

The stop processing for the second reel R2 after the first reel R1 is stopped, is as follows. First, in the case that a big hit request is being generated, the flow chart shown in FIG. 18 is utilized in order to proceed with the processing. If an array or alignment of symbols for a winning is attained, a necessary processing is carried out in order to make the array appear. In the case that a middle hit request is being generated, the first judgement in the flow chart shown in FIG. 18 is considered as "any alignment for a middle hit?" similarly as in the case of the first reel processing. In the case a small hit request is generated, only a processing for making the second reel R2 stop, is carried out. In the flow chart, the processing for forming a combination table for each winning line, is carried out, for example as shown in FIG. 19, by writing the combination of symbols for each winning line into the RAM 52. It is assumed that the first reel R1 is at a stop at the code number "15" (refer to FIG. 12), and the stop operation for the second reel R2 has been initiated at the position corresponding to the code number "18" of the second reel R2. Then, taking account of the description given with respect to FIG. 14, symbol numbers for each line are obtained as shown in the table of FIG. 19. The symbol numbers are obtained by referring to the four subsequent symbol codes for each line. If the portion of a combination of symbol numbers, for example, "2(B)-2(B), or 3(C)-3(C)" is contained in the combination of symbol numbers for a big hit, then a flag "1" indicative of the presence of an alignment is set up and stored. If the portion of a combination of symbol numbers, for example, "6(F)-6(F)" is contained in the combination of symbol numbers for a middle hit, then a flag "1" indicative of the presence of an alignment is set up and stored. In this case, therefore, if a middle hit request is generated, the portion of a combination of symbol numbers "6(F)-6(F)" aligned along the line 1 is held at this position by stopping the reel R2. When the second reel R2 is stopped at this position, the symbol numbers for the second reel R2 are stored in each RAM shown in FIG. 14. After the stop of the second reel R2, a further processing is carried out in accordance with the flow chart shown in FIG. 20. In the processing P20 in FIG. 20, the portion of a combination of symbol numbers, previously obtained from the stop positions of the first and second reels R1 and R2, is considered. Every symbol number of the third reel R3 is checked, introducing an imagninary stop of the symbol number at the winning line 1, to determine whether the symbol number on the third reel R3 can produce a winning or not if it is combined with the combination made up of the first and second reels R1 and R2. Thus, the winning possibility is checked for all the winning lines, and the results are stored as hit flags which are set up for each code number of the third reel R3, the flags indicating the presence or absence of hits, and if present, further indicating a big, middle, or small hit. The results are shown in the table of FIG. 21. This winning judgement processing is exeucted in accordance with the flow chart shown in FIG. 22. In the table shown in FIG. 21, it is assumed that the first reel R1 is stopped at the code number "17", that is, at the symbol and symbol number "6(F)", and that the second reel R2 is stopped at the code number "19", that is, at the symbol and symbol number "6(F)". With the above processing, it is possible to check all of the hits to be generated if the third reel R3 is stopped at an appropriate symbol.

(3) PROCESSING FOR THE THIRD REEL

Figure 23:
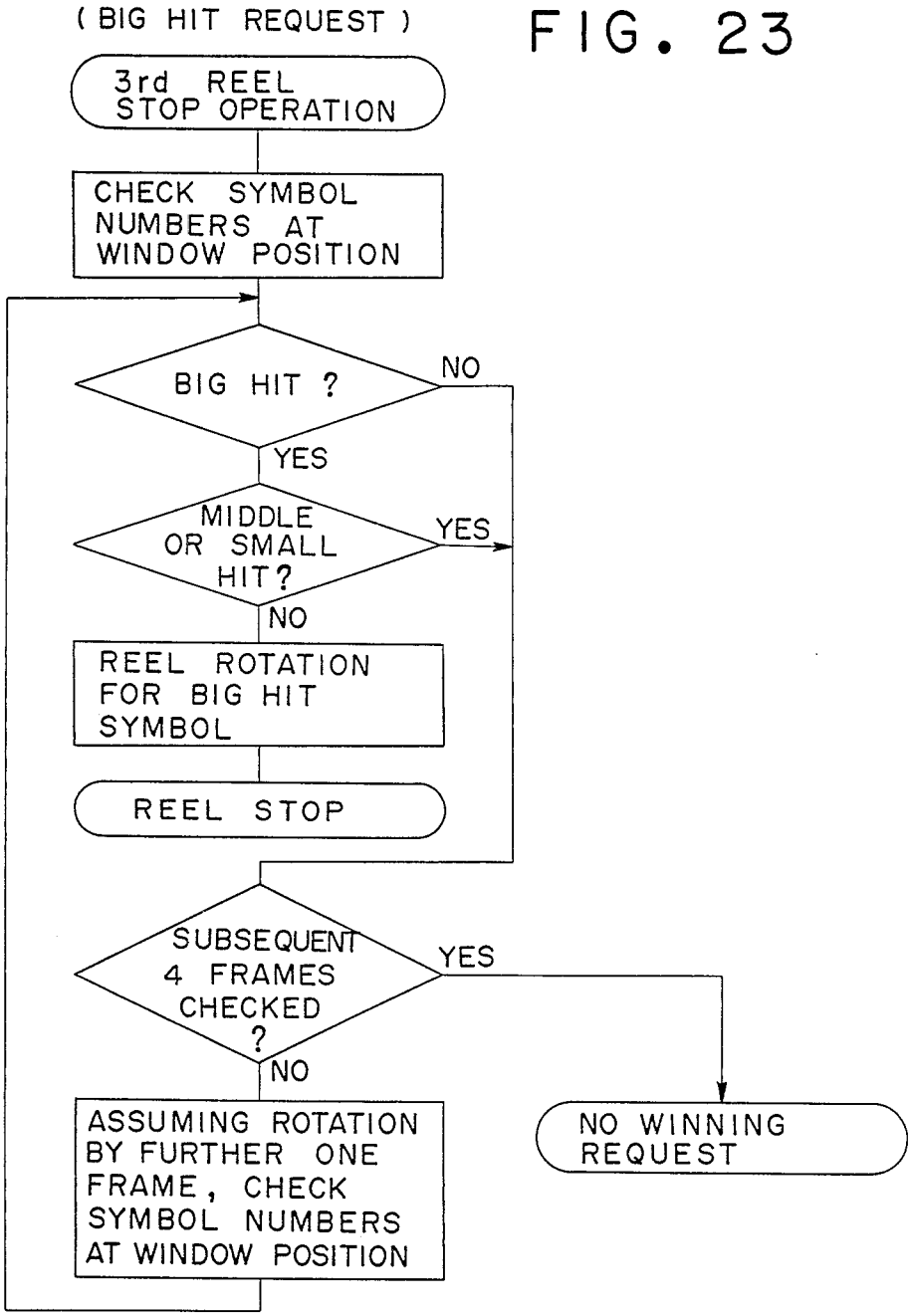
FIGS. 23 and 24 respectively show flow charts illustrating a stop processing for the third reel.
Figure 24:
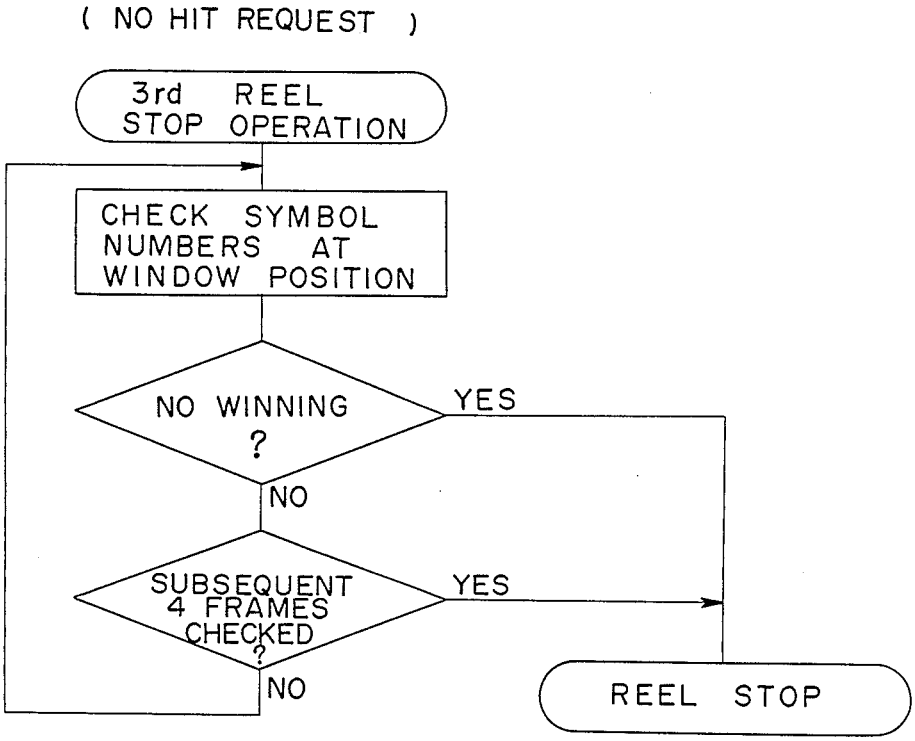

After completion of stop processing for the second reel R2, further stop processing for the third reel R3 starts. In the case that a big hit request is generated, the flow chart shown in FIG. 23 is followed. The judgement whether there is any hit or not is carried out, with reference to the winning status table (FIG. 21) previously made up after the stop of the second reel R2. In the case that there is a middle hit, the same flow chart can be used by interchanging the positions of the two blocks for hit judgement steps. In the case that a small hit request is generated, any symbol can essentially suffice for the third reel R3. However, there is a possibility to obtain a big or middle hit on a plurality of winning lines, so it is necessary to check the symbols subsequent to that of a stop position of the third reel R3. Furthermore, in the case that there is no hit request, it is also necessary to perform a check because there is a possibility that the first and second reels R1 and R2 constitute a portion of a combination of symbols which makes up a big or middle hit. This check processing is carried out in accordance with the flow chart shown in FIG. 24. For example, it is assumed here that the first and second reels R1 and R2 are at a stop at the positions corresponding to the code numbers "17" and "19", respectively (see FIG. 22). Then if the third reel R3 is caused to stop at the position between the code numbers "3" and "4", a check is carried out for the symbols corresponding to the first code number "4" to the code number "8". If the first code number is selected, there would occur a middle hit. Thereafter, the third reel R3 is stopped, for example, at the code number "5" following by one frame after the first code number. As previously described, in the winning status table shown in FIG. 21, the presence or absence of winning is shown not only for the winning line 1, but also for all the other winning lines. Therefore, by referring to the table, the presence or absence of winning does not overlap.

Figure 25:
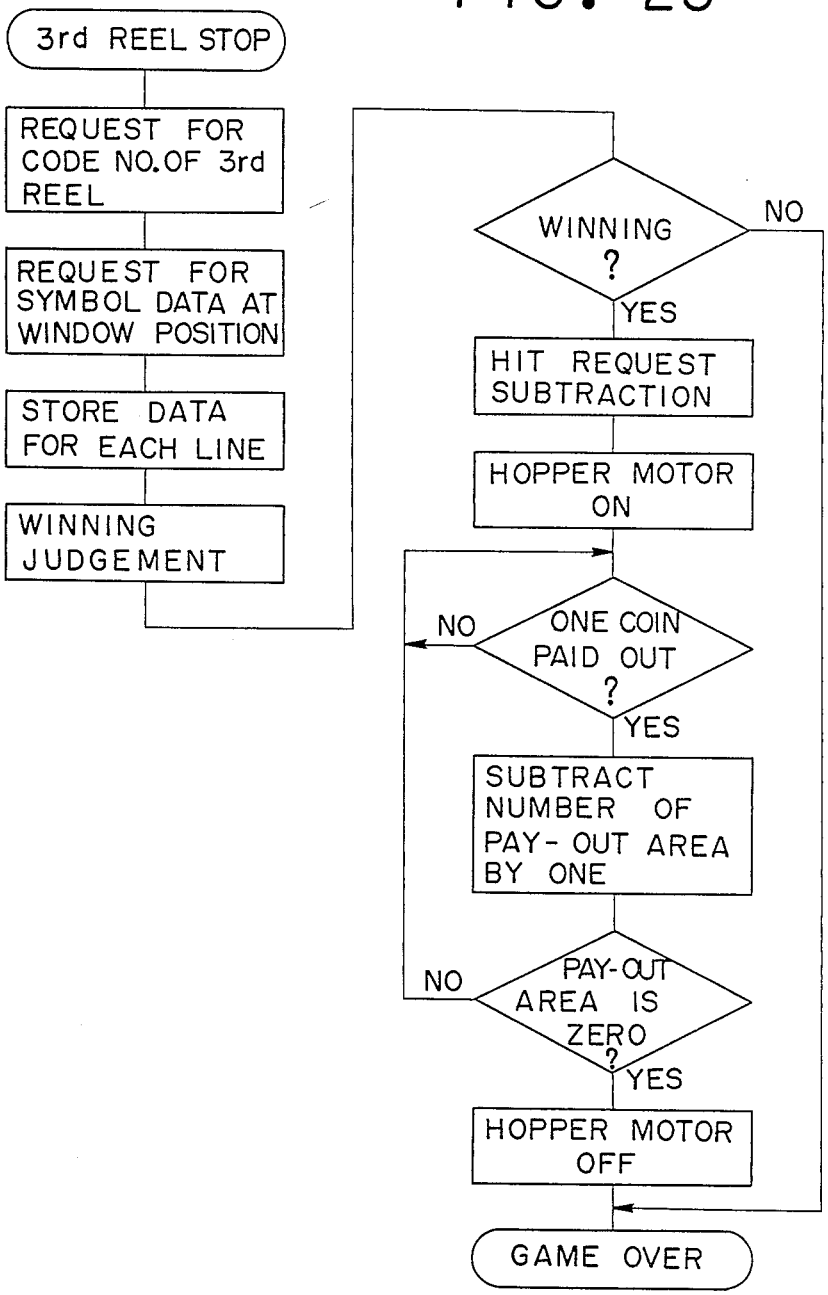
FIG. 25 is a flow chart illustrating a processing after the third reel has been stopped.

After the third reel R3 is stopped, a processing according to the flow chart shown in FIG. 25 proceeds. That is, upon the stop of the third reel, the symbol marks for all the reels appearing in the windows are definitely fixed. Thus, each RAM area shown in FIG. 14 is filled with data. At this time instant, the winning judgement processing of FIG. 22 is again executed. If there is a win, the contents of the hit request at the start of the game is subtracted by one, and thereafter the motor 77 for paying out coins from the hopper is turned on. As will be appreciated from FIG. 22, in the winning judgement processing after the stopping of the third reel R3, the number of coins to be paid out for the winning is stored in a pay-out area (RAM in FIG. 14). Every time a coin is paid out from the hopper 71, the number stored in the pay-out area is reduced by one (−1), until the number reaches to "0" when the motor 77 for the hopper is turned off and the game is terminated.

Data processing for a game has been described assuming that the reels R1 to R3 are to be stopped sequentially from the left in FIG. 2. Any other order for stopping the reels can be readily employed in a similar manner as in the previous description. The control for the stopped position of the reel has been explained assuming that the four subject frames are subjected to control. It is likely that a particular symbol corresponding to a hit request cannot be found among those four subsequent frames (it is throughly possible for such a case to occur because there are few big hit symbols). In this case, a hit request is not satisfied, so that the preset winning probability is lowered. Particularly a big hit has a large effect upon this lowering. In order to make it proper, the contents of a hit request, with which no win was obtained at a game, may be retained for the next game. If the check and control for the four subsequent frames is changed to increase the number of frames, such as to 10 frames, then as a matter of course, the probability degree of attaining a hit request is improved. Further, it is to be noted that the pay-out rate is made stable to the value shown in the winning probability table, if a symbol indicative of no hit is made to be present among the four subsequent frames on the symbol arrangement of the third reel R3.

Figure 26:
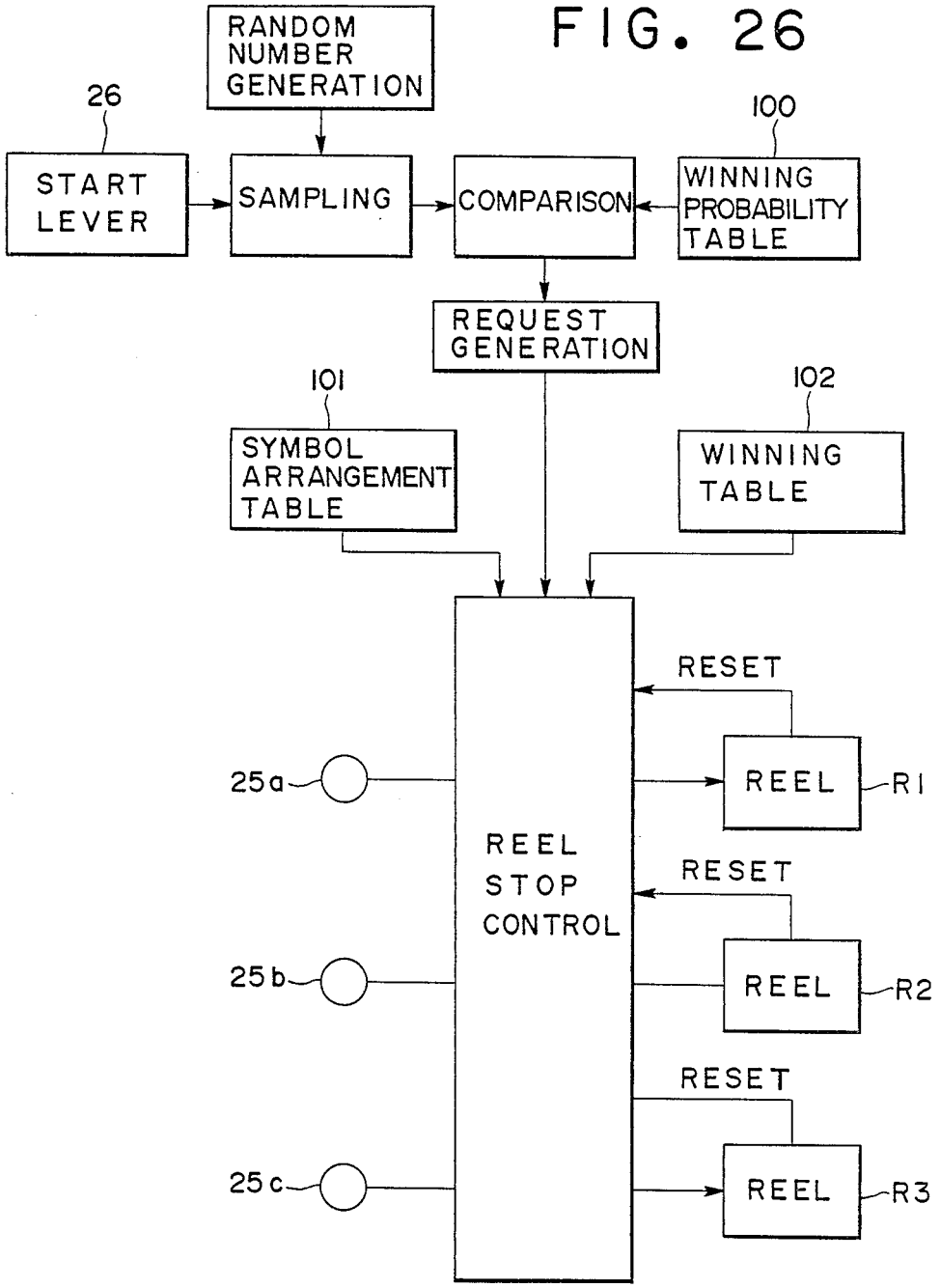
FIG. 26 is a block diagram illustrating fundamental functions of a slot machine according to the present invention.

The fundamental function of the slot machine according to the present invention can be shown in FIG. 26. At any time instant when the start lever 26 is actuated, a random number is sampled. The sampled value is in turn referred to the winning probability table 100 to generate a request. Then, referring to the symbol arrangement table 101 and the winning table 102, each reel R1 to R3 is controlled so as to provide a win corresponding to the request. A limited condition of an operating timing of the stop lever by the player is added to the above reel control, so that a random nature as well as technique attributable to the player can be added to the game. The pay-out rate can on the average be maintained fairly constant, in compliance with the winning probability table 100. The pay-out rate can also be set as desired. Therefore, almost all of the winning arrangements can be made to occur irrespective of the high or low dividend, with a certain preset pay-out rate being preserved. Furthermore, the bias that each slot machine might otherwise have can be avoided.

The present invention can also be applied to those types of slot machines in which reels are stopped automatically or reels are displayed on a CRT through video signals. Furthermore, the control function for stopping reels can be modified and changed in order to incorporate any number of reels and symbols into the slot machine.

What is claimed is:

1. A slot machine of the type having plural series of moving symbols juxtaposed to each other, each of said plural series of symbols comprising a plurality of moving symbols arranged in an array and in which a predetermined number of coins is ejected when combinations of symbols on prize-winning lines on said array coincide with predetermined prize-winning combinations, said slot machine comprising: random number generator means for generating a plurality of random numbers within a predetermined range; sampling means for selecting one random number out of said plurality of random numbers generated by said generator means; a winning probability table for storing a relationship between a group and said random numbers, the group being one of a plurality of groups made up by classifying prize-winning combinations; judgment means including means for judging whether the value of said random number corresponds to any of said numerical values representing said groups said judgment means also including means to judge whether a win can be awarded or not and, in the affirmative, further including means for judging to which of said groups said random number belongs, by referring to said winning probability table; hit request signal generator means for generating a hit request signal upon judgment of a win by said judgment means, said signal requesting the machine to stop said moving symbols so as to display one of a particular group of prize-winning combinations in the group judged by said judgment means; and control means responsive to said hit request signal for so stopping said symbols.

2. A slot machine as set forth in claim 1, further comprising count means for calculating the remaining number of winnings for each of said groups, means for deciding the number of wins obtainable during a predetermined N number of games for each of said groups, means for reducing the hit request signal by "1" every time said hit request signal is generated, wherein the remaining number of wins for a group corresponds to the generated hit request signal being reduced by "1", and means for inhibiting display of said prize-winning symbol combinations belonging to said group when the remaining number of wins reaches "0", even if a further hit request signal for said group is generated.

3. A slot machine as set forth in claim 1, in which said plurality of groups are classified into three kinds, namely, a big hit, a middle hit, and a small hit.

4. A slot machine as set forth in claim 3, in which said sampling means is made operative after the start of the movement of said plural series of symbols, and derives one of said random numbers.

5. A slot machine as set forth in claim 1, in which said series of movable symbols are disposed on a plurality of reels, and a pulse motor rotates each of said reels.

6. A slot machine as set forth in claim 5, further comprising evaluation means for evaluating, every time one of said reels stops, whether it is possible to complete a prize-winning symbol combination belonging to said group previously determined, and means to control said control means in accordance with the evaluated results.

7. A slot machine as set forth in claim 6, further comprising a start lever for initiating the rotation of said plurality of reels.

8. A slot machine as set forth in claim 7, further comrising stop buttons each for stopping the rotation of respective reels.

9. A slot machine as set forth in claim 8, further comprising judging means for judging symbols on said winning lines at a time instant when said stop button is operated, and in which a stop position of the reel to be stopped by said stop button operation, is controlled so as to complete a prize-winning symbol combination belonging to said group previously determined.

10. A slot machine as set forth in claim 9, in which the stop control for said reel is carried out for M frames following the time instant when said stop button is operated.

11. A slot machine as set forth in claim 10, in which M is four.

12. A slot machine as set forth in claim 1, further comprising hit request count means for storing the hit request signal, until the prize-winning symbol combinations corresponding to the said hit request signal are caused not to be completed, and means for applying the said hit request signal for the subsequent game.

* * * * *